US012011103B2

(12) United States Patent
Cerwen

(10) Patent No.: US 12,011,103 B2
(45) Date of Patent: Jun. 18, 2024

(54) DEVICE FOR MOUNTING FLAT PIECES OF ART

(71) Applicant: Erik Audunn Cerwen, Likenas (SE)

(72) Inventor: Erik Audunn Cerwen, Likenas (SE)

( * ) Notice: Subject to any disclaimer, the term of this patent is extended or adjusted under 35 U.S.C. 154(b) by 22 days.

(21) Appl. No.: 17/229,814

(22) Filed: Apr. 13, 2021

(65) Prior Publication Data

US 2021/0337987 A1 Nov. 4, 2021

Related U.S. Application Data

(60) Provisional application No. 63/019,980, filed on May 4, 2020.

(51) Int. Cl.
*A47G 1/06* (2006.01)

(52) U.S. Cl.
CPC ..... *A47G 1/06* (2013.01); *A47G 2001/0677* (2013.01)

(58) Field of Classification Search
None
See application file for complete search history.

(56) References Cited

U.S. PATENT DOCUMENTS 213,344 A * 3/1879 Pattberg ..... A47G 1/0605 40/796
1,041,776 A * 10/1912 Gibson ..... A47G 1/06 40/796
1,342,477 A * 6/1920 Walas ..... A47G 1/06 40/742
3,996,682 A * 12/1976 Schwartz ..... A47G 1/0605 40/794
4,282,667 A * 8/1981 Glade ..... G09F 15/0012 40/611.05
4,596,488 A * 6/1986 Schendan ..... A47G 1/101 403/402
5,282,537 A * 2/1994 Wong ..... A45C 11/00 217/11
5,983,547 A * 11/1999 Ellis ..... A47G 1/0605 40/792
7,240,447 B2 * 7/2007 Humphrey ..... A47G 1/06 40/777
7,272,903 B2 * 9/2007 Roy ..... A47G 1/06 292/281
2006/0218839 A1 * 10/2006 Vineyard ..... A47G 1/06 40/796
2008/0110072 A1 * 5/2008 Lacoff ..... A47G 1/12 40/745
2009/0119965 A1 * 5/2009 Broehl ..... A47G 1/06 40/721
2012/0159827 A1 * 6/2012 Roy ..... A47G 1/0605 40/796
2015/0320240 A1 * 11/2015 Michel ..... G11B 33/0422 40/745

* cited by examiner

*Primary Examiner* — David R Dunn
*Assistant Examiner* — Christopher E Veraa

(57) ABSTRACT

The invention constitutes a device in which flat artwork, like drawings, woodblock prints, photos and posters can be mounted, having the properties that the artwork easily can be circulated from archives into and out of the device without being damaged by mounting. It is, basically, a frame with a back support in the form of a board that can be opened and closed like a door whereby the artwork is mounted by pressure from this board without using tape, photo corners or glue or any other potentially harmful methods.

9 Claims, 4 Drawing Sheets

DEVICE FOR MOUNTING FLAT PIECES OF ART

CROSS-REFERENCE TO RELATED APPLICATIONS

I. Statement of Claimed Priority

This application claims the benefit of U.S. Provisional Patent Application No. 63/019,980, filed on May 4, 2020. With reference to the provisional application mentioned the present application has in addition a better description of the prior art and an improvement of the claims, in particular the independent claims in which the piece has been described the shape of which was mentioned in the provisional application to be "necessary for use in the invention". The claim of priority from U.S. 63/019,980 has also been made in an accompanying Application Data Sheet (Form AIA/0014).

II. Prior Art

U.S. Patent Documents

U.S. Pat. No. 4,033,058 July 1977 Lyman
U.S. Pat. No. 4,672,758 June 1987 Le-Carpentier
U.S. Pat. No. 4,947,565 August 1990 Shadwell
U.S. Pat. No. 5,042,180 August 1991 Horiuchi
U.S. Pat. No. 5,092,063 March 1992 Shultz
U.S. Pat. No. 5,335,434 August 1994 Shultz
U.S. Pat. No. 5,371,924 December 1994 Schmale
U.S. Pat. No. 5,437,428 August 1995 Mirza
U.S. Pat. No. 5,533,288 July 1996 Lambert
U.S. Pat. No. 6,557,810 B2 May 2003 Roy
U.S. Pat. No. 7,069,682 B2 July 2006 Gatt
U.S. Pat. No. 7,536,814 B2 May 2009 Ross
U.S. Pat. No. 7,946,067 B2 May 2011 Lambert
U.S. Pat. No. 8,800,188 B1 August 2014 Fishelis
U.S. Pat. No. 10,051,981 B2 August 2018 Welch
U.S. Pat. No. 10,506,888 B2 December 2019 McMahon Foreign Patent Documents EP 1 964 087 B1 March 2014 Cook
EP 3 446 598 A1 February 2019 Rusokallio

STATEMENT REGARDING FEDERALLY SPONSORED RESEARCH OR DEVELOPMENT (NOT APPLICABLE)

REFERENCE TO SEQUENCE LISTING, A TABLE, OR A COMPUTER PROGRAM LISTING COMPACT DISC APPENDIX (NOT APPLICABLE)

BACKGROUND OF THE INVENTION

1. Field of the Invention

The invention relates to the field of displaying flat pieces of art, drawn, printed or painted on thin sheets of paper or photo paper. This is done in museums, by art collectors and in every private home in order to achieve a personalized appearance of one's home. The invention describes a device to be used for displaying on a wall pieces of art like drawings, woodblock prints, photos, posters and similar flat artwork that are circulated from an archive into the display with only one item displayed in the device at a time and the other items being stored in the archive meanwhile. The device is constructed with the purpose that the pieces of art easily can be circulated into the display and be enjoyed alternately without damage by mounting and without the bulky use of individual frames for each and every artwork.

2. Description of Prior Art and Scope of the Invention

Frames for mounting planar pieces of artwork have been known and used for centuries. One sub-group of such frames are those that in addition to the frame proper consist of a transparent surface, usually made of glass, and a backing, usually made of some stiff planar material (a board), in between which the artwork is mounted such that it can be viewed through the transparent surface while being kept in place by the stiff backing or adhesives and thereby protected from damage from the environment. Such frames have also been known and used for centuries but novel constructions nevertheless appear again and again in recently granted patents. Not only is this field of industrial endeavor still important as shown by the persisting interest in its intellectual property, it is founded in human nature and can be traced back to planar wall paintings in 10000 years old living rooms excavated in Minor Asia and even back to cave wall paintings such as known from the Iberian Peninsula and elsewhere.

Improving the above mentioned sub-group of frames that have, in addition to the frame proper, a transparent surface and a backing, is the subject of the present invention. Namely, in the past decade(s) the technical development has enabled anyone to manufacture or order many different pieces of high quality planar artwork by photocopying at a relatively low cost compared to the photography of the past century and the hand-drawing-painting of the remote past. This technical development calls for a mounting-frame into which the pieces of art can be circulated and exchanged easily. To accomplish this is the scope of the present invention.

In most prior art of the field of the invention the pieces of art are mounted permanently in frames which are hung onto a wall or they are glued, pinned or taped directly onto the wall. The permanent frames, which are required for more valuable pieces of art, are bulky and expensive which leads to a psychological resistance against displaying new pieces of art. As a consequence many art collectors have items in archives where they can not be enjoyed. Likewise, museums do not circulate their archived pieces of art into display for the public on a daily or weekly basis as could easily be done if it were convenient to do so. As for posters and photos and the like, private home owners avoid the qualitative enhancement of having their artwork framed because it would imply a rather disproportionate expensive investment merely for one single item that is not so valuable per se. Hence, this invention is intended to be used by art collectors, museums and anyone carrying on the millennia-old tradition from ancient civilizations of displaying flat-shaped art by facilitating its circulation and display. The purpose of the invention is to simplify mounting and circulation of pieces of art into frames to catch up with the technologies of producing them. The need for devices accomplishing this has also been noted in some recently granted patents, e.g. U.S. Pat. No. 10,506,888 B2 (2019), U.S. Pat. No. 7,069,682 B2 (2006), EP 3 446 598 A1 (2019), U.S. Pat. No. 5,092,063 (1992), U.S. Pat. No. 4,672,758 (1987).

In contrast to the most recent prior art, however, the objective of easily replacing and fixing into position some planar artwork into a frame is achieved, neither by rigid screws and bolts and pieces of metal of peculiar shapes that are difficult and costly to manufacture nor by adhesive tape that often looses its grip as time passes and is inconvenient to replace, but by a flat metal cut such that it can be rotated into position across two opposing parts of the frame proper on its back side and after thus having been positioned it exerts pressure on the center of the invention's back piece due to spring-like strain onto the back piece from two opposed furrows in the two opposing sides of the frame proper. Holding the piece of artwork in place by exerting pressure on the center of the back-piece and not merely along its edges is missing in much prior art; an implied but not mentioned prerequisite of most prior art is consequently that the artwork is attached to the backing or to the matte using adhesive tape or even glue. The harmful effects on the artwork by such wide-spread procedures can easily be certified by anyone dealing with century-old prints and etchings. Just like putting an artwork into a frame has been known and practiced for a long time the concept of a 'hinge' has also been known for centuries and hinge mechanisms attached to and used on the frame's back-piece in combinations with other procedures also appear in some prior art relevant to the present invention, for example U.S. Pat. Nos. 10,506,888 B2, 6,557,810 B2, 4,947,565, 4,033,058. However, the prior art neither describes the physical shape of the hinge used herein, which can be optimized for product development as indicated below, nor the concept of applying spring-like pressure onto the center of the back-piece by rotating into place a purpose-cut sheet metal, the latter implementing the gist of the invention. This latter improvement, described herein and in U.S. 63/019,980, makes it is possible to replace one piece of art for another in the frame in less than a minute, while robustly fixing it into position without inflicting damage to it. By achieving this objective the present invention significantly facilitates the consecutive display of artwork being circulated into a frame from an archive.

BRIEF SUMMARY OF THE INVENTION

The invention constitutes a device in which flat artwork, like drawings, woodblock prints, photos and posters can be mounted, having the properties that the artwork easily can be circulated from archives into and out of the device without being damaged by mounting. It is, basically, a frame with a rear support in the form of a board that can be opened and closed like a door whereby the artwork is mounted by pressure from this board without using tape, photo corners or glue or any other potentially harmful methods.

DETAILED DESCRIPTION OF THE INVENTION

Figure 1:
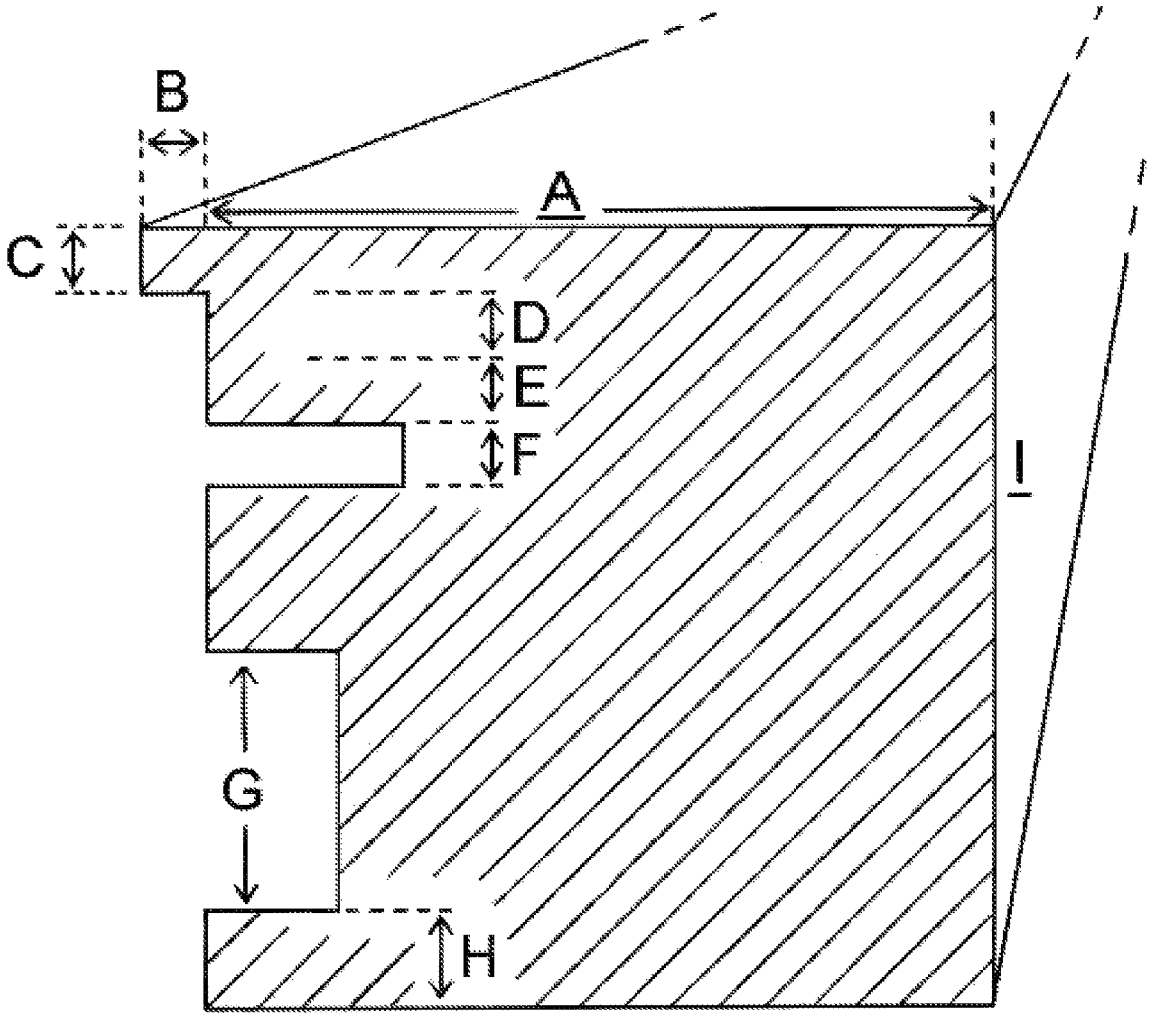
FIG. 1. A schematic illustration of a cross section transverse to the extension of the parts that will form the frame into which will be mounted the pieces of art for which the invention is intended. The oblique fuzzy lines represent the cross section, solid lines represent the contours of the object and dashed lines indicate extensions of length measures. The letters indicate locations of various functions described below and in the main text of this document. Four such pieces as illustrated in the drawing will be put together to form a rectangular or square-shaped frame with the left side in the drawing facing inwards towards the mounted piece of art and the upside and right side in the drawing representing the frame that will be seen by people viewing the piece of art. The various protrusions and furrows in the drawing are not to scale with each other offering the joiner great flexibility in implementing the invention. The gross scale is roughly such that the distance 'A' is approximately 3-4 cm in most cases but when applied to very large pieces of art such as posters this distance will be longer, hence the frame will be thicker. The letters in the drawing refer to the following: 'A' and 'I' indicate the parts of the frame that will be seen and these sides can be designed artistically with great freedom by the joiner just like in the case of traditional frames. Part 1 described in the main text of this document, the transparent glass, Plexiglass, polycarbonate or other kind of polymer surface, that is, is placed at the level represented by the letter 'D' and glued from below onto the protrusion 'B'-'C'. The distance 'B' can be chosen by the designer but it must be sufficiently long that it hides, when viewed from the front (=upside in the drawing), the holes into which the hinge of Part 2, also described in the main text, is inserted. These holes are drilled from the left in the drawing at the level 'E' near the ends of two opposing parts of the frame and at these locations where the holes are drilled there must not be any furrow 'F'. Elsewhere around the inside of the rectangular frame the furrow 'F' serves the purpose of anchoring the pieces of wedge illustrated in the upper left part of FIG. 2. These wedges, when inserted, push the edges of Part 2 against Part 1 and it is obvious that in order to do so, Part 2, when mounted, must partly overlap onto and above the furrow 'F'. Thus, Part 2 is thicker than the distance 'E'. The furrow 'G' serves two purposes. One purpose, described in the text, is to support the springy metal arc that pushes the center of Part 2 against the center of Part 1. The other purpose is to harbor nails or screws from which the frame with its mounted piece of art can be hung on a wall. Two times two such nails or screws are needed in order to let the user choose between portrait or landscape type mounting. These nails or screws can be attached parallel to the arrows above and below the letter 'G' preferably in the middle of the furrow 'G' and running through the furrow in its entirety parallel to the arrows 'G'. By hiding the nails in the furrow they do not obstruct Part 2 from rotating on its hinge. As for the location of these nails or screws along the frame extending from the hinge of Part 2 it is preferable to insert them on the far side from the hinge. A chain, a wire or a string with hooks at its two ends to be attached to these nails can be supplied with the invention in order to let the user hang the frame with its mounted piece of art on a wall. The furrow 'G' may be made deeper than what it appears to be in the drawing in order to accomplish this. Even though wood is the natural choice for the frame it can of course also be made using some other material that preserves these just described functions.

In the invention, the object of conveniently circulating pieces of art out of and into a frame without damaging them is achieved using a device composed of three major parts that are joined together permanently and several supplementary parts that perform specific functions when applied to the main device composed of the three major parts.

The three major parts are as follows:

1) Part 1 is a light-transparent rectangular board that can be made of glass, Plexiglass (Reg.) or polycarbonate. This board is typically around 5 mm thick, around 49 cm long, and 36 cm wide (in Example 1; Example 2: 46.3 cm×32.5 cm) but especially its length and width can vary considerably depending on the size of the objects of art that will be framed. An advantage of using polycarbonate is that it protects to some degree against ultraviolet radiation, which may have the harmful effect of causing bleaching of valuable artwork. A disadvantage of polycarbonate, however, is that it is rather soft so that it easily is scratched. Polycarbonate and plexiglass have the advantage relative to glass that they are not easily broken by impacts. Other materials and polymers can also possibly be used for this Part 1 of the invention and the manufacturer can easily determine which material will be best suited for the purposes considered. Part 1 of the invention must be transparent to light. As described in the text to FIG. 1, part 1 is glued into the frame at the level indicated by a letter 'D'.

2) Part 2 of the invention is also a board, typically around 5 mm thick with slightly shorter length and width than Part 1. Its length and width should be such that it fits closely into the frame built from Part 3 (see paragraph labeled 3 below) with enough, but as little as possible play against the frame to allow the rotation of Part 2 on its axis as described below. This board, Part 2, should have some springiness so that it can be pressed from underneath onto Part 1. Along one edge of Part 2 is attached a rod that serves as a hinge so that Part 2 can be turned on the axis constituted by this rod in order to get access to Part 1 from beneath. On the surface of the board, facing Part 1, is attached a porous paper which, by its porosity offering friction, serves the purpose of preventing the piece of art from slipping downwards when mounted in the frame and hung on a wall. Other materials can also be used for this, a very thin white horticultural fleece made of polymer can be mentioned as an example. Several materials are possible to use for the core of the board. As a concrete example herein, masonite (Reg.) having thickness of 3 mm was used and the hinge was made by gluing an iron rod of 5 mm diameter onto one edge of the masonite board such that the glossy surface of the masonite and the circumference of the rod were even-leveled. The rod protruded on both sides of the board by 7 mm such that it could be inserted into holes in two perpendicularly oriented parts of the frame (see below) thus forming a hinge. It is preferable to attach the rod to the shorter edge of the board, along its width. Two-component Epoxy glue readily available commercially was used for this. There are more than one quality of masonite available on the market and the quality that is comparatively resistant towards moisture is recommended for use in the invention. However, the invention is not limited to use of a masonite board and an iron rod. Many other materials are conceivable such as some plastics or even very stiff cardboard, as long as some kind of hinge can be built into or attached to one edge of the board.

Care should be take that chemicals with potentially harmful effects on the artwork to be mounted are not used. In the case of masonite for example it may contain acid, known to cause paper to turn yellowish-brown after long exposures. Such materials may be covered with more compatible coatings, e.g. varnish before being used in the invention. A prerequisite for a good choice of material is that the board is 'springy' (in the sense that when bent it stores potential mechanical energy) so that it can be pressed from underneath against Part 1. An advantage of masonite in this respect is that it is inherently somewhat convex, its glossy surface bending out. There should be porous paper or other similar porous material attached to this surface of Part 2 facing Part 1. This porous paper may serve as a background for the artwork to be mounted in the frame besides its function in the invention to increase the friction so that the artwork is prevented from slipping downwards due to gravity. Besides the paper attached permanently onto the surface of Part 2 additional loose sheets of paper of the same length and width as Part 2 can be distributed with the invention in order to optionally increase the pressure exerted from Part 2 onto Part 1 in the event that the original coating turns glossy and flat with extended use. The pressure can also be increased by placing a 'passe-partout' (French lang., cf. 'matte') above the artwork. This diminishes the artwork's contact with the transparent material (Part 1) above it, especially if the passe-partout is thick, say, in the range of 1-2 mm. The pressure on the artwork will then decrease except at its margins, which may be considered an advantage in the case of valuable pieces of art. Whereas glass is inert and has been used for a long time in artwork frames the long-term effect of some new polymers and their low molecular weight residues is not known and may be considered risky for use with valuable artwork. The user may prefer to protect the pieces of art additionally, for example by inserting them into mylar sleeves before mounting in the invention. If so, the mylar can be folded onto the back of Part 2 and attached with tape.

3) Part 3 is typically made of a strip of wood such as abundantly available in the joinery profession. A general outline of Part 3 is shown as a cross section in FIG. 1. Here the strip of wood is depicted as one single piece but it may also be put together (glued, nailed or screwed) using several strips of wood such that the object of the invention is achieved. In FIG. 1, the various protrusions, indentations, and distances (marked by letters) are not intended to be on scale so that anyone skilled in the art can decide which measures are best suitable for the purposes considered by each one manufacturing the invention. Especially the protrusion marked with the letter 'C', beneath which Part 1 is glued, can be longer. FIG. 1 not being on a uniform scale allows a great freedom to design the frame. The approximate scale of FIG. 1 is such that the length 'A' and the side 'I' are around 3 cm in most cases. However the size of the artwork to be framed influences which scale is most appropriate and a large piece of artwork would require greater measures of the cross sectioned area in order for the invention to work. The left side of the cross section is intended to face inward towards the center of the assembled frame so that the frame is put together by four such pieces sawed out of the long strip(s) of wood the cross section of which is shown in the drawing. The four pieces of wood thus forming two lengths and two widths can be sawed at an angle of 45 degrees facing inward (left in the drawing) so that they easily can be joined. This is appropriate especially when the strip is made out of one single piece of wood and its furrows and protrusions are manufactured with machinery.

However, it is also possible to make the frame manually out of several pieces of wood. If so, the pieces chosen determine the most convenient way to assemble Part 1, Part 2, and Part 3 into a permanent structure.

Figure 2:
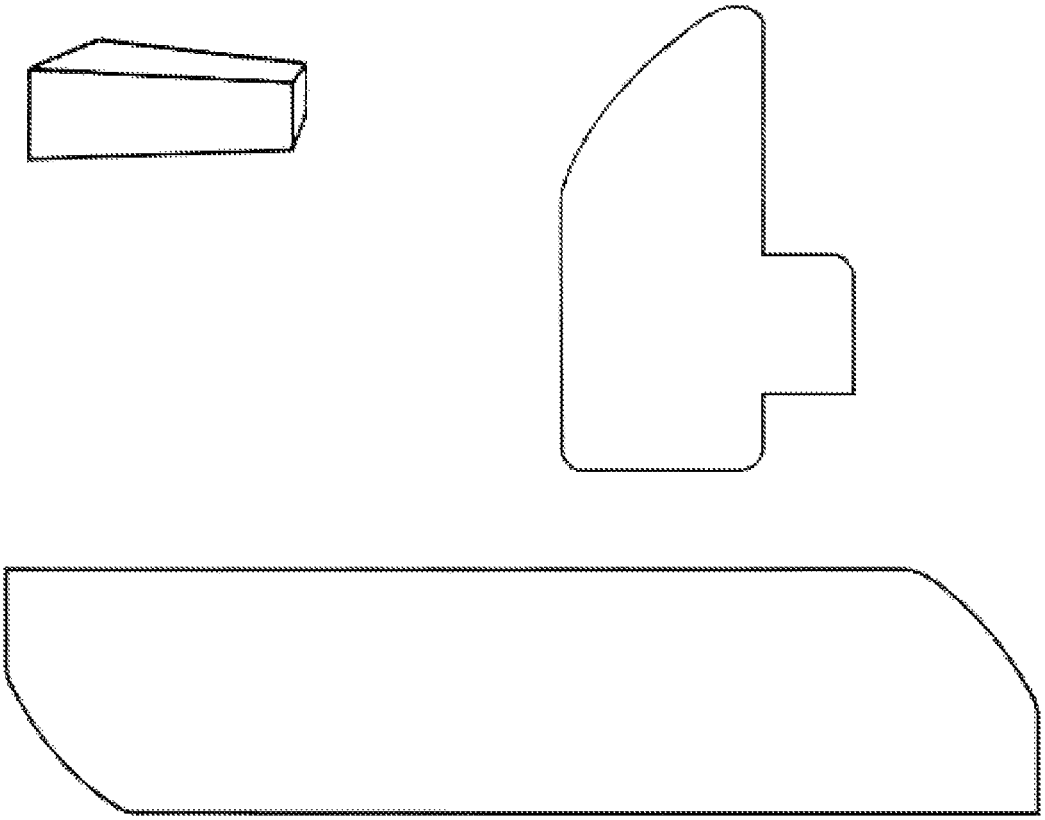
FIG. 2. Schematic illustration of some parts that perform the function of pressing Part 2 against Part 1 in the assembled main device. To the upper left is illustrated the wedge that is pressed into the furrow 'F' in FIG. 1. Several such pieces of wedge can be used. To the upper right is illustrated another item that may perform the same function as the wedge but intended to rest in the furrow 'G' instead of 'F'. The top of this device is rounded and made to snap into yet another very shallow furrow located on the rough side of the masonite board (Part 2) along its edge towards the frame. This item is oriented in the drawing such that it is inserted from the left into the furrow 'G' of the cross section of the frame illustrated in FIG. 1. In the lower half of the drawing is illustrated schematically a piece of sheet metal to be strained into an arc resting in two opposing furrows 'G' such as to exert pressure on the center of Part 2. This sheet metal is cut such that it can be approached to the furrows from an oblique orientation and then rotated parallel to the board-Part 2 until it forms an arc that exerts pressure on Part 2. The rounded shape of the two corners as shown is necessary for inserting the metal as described. The length of this piece of metal must be adjusted rather well to the exact distance between the bottoms of the two opposing furrows 'G' also taking into account the exact distance from the level 'G'-'H' to the level 'E'-'F'. These measures define the length of a segment of an arc of a circle and the metal must be somewhat longer than this. For serial production of the invention in some definite size the length of the metal can easily be determined once and for all by trial and error such that it performs its function described above and then mass-produced with the empirically determined measures. The metal sheet is typically 1 mm thick or slightly thicker.
Figure 3:
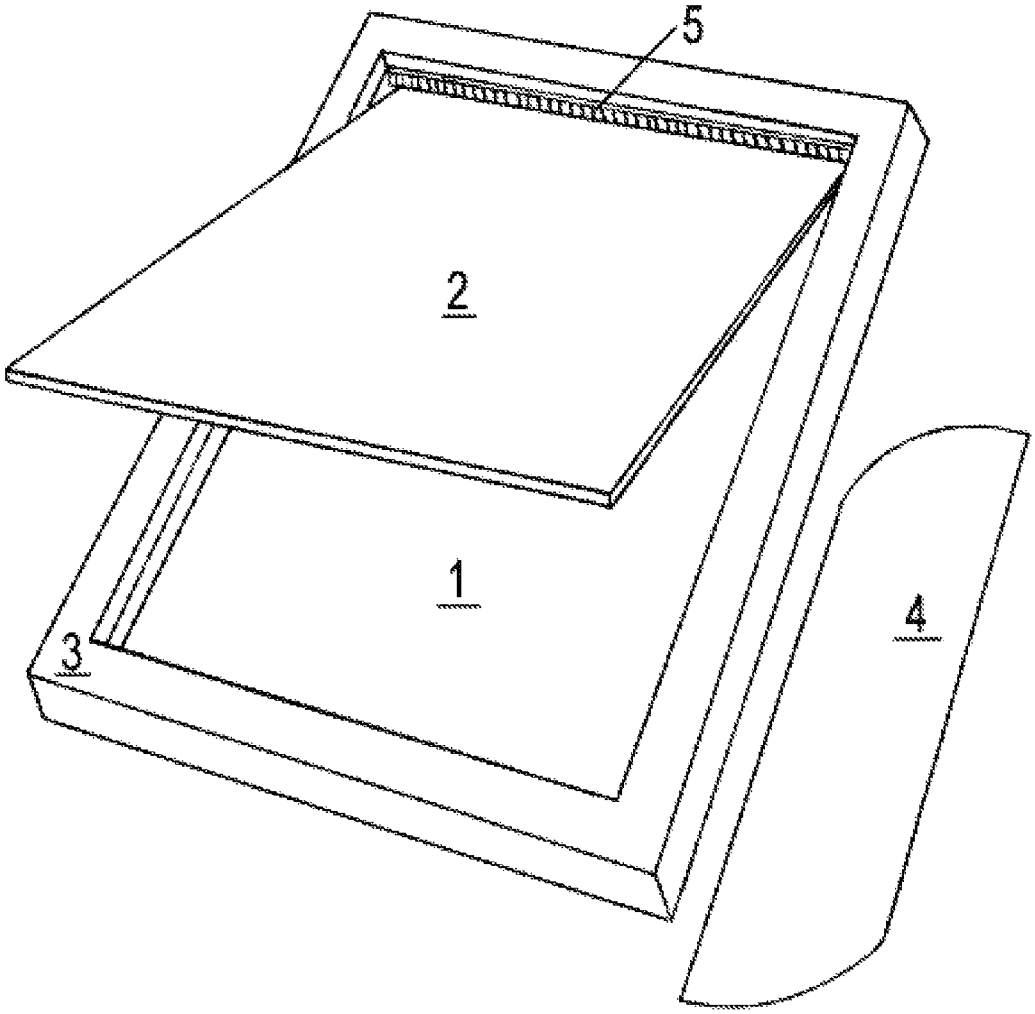
FIG. 3. Schematic perspective illustration of the artwork frame in an open position (upper left) into which a piece of flat artwork can be inserted and the piece that will form an arc exerting pressure (indicated by the number '4', lower right, also shown in the lower half of FIG. 2). 1. Transparent Front Surface. 2. Backpiece (rear board) in an open position. 3. Frame (as in FIG. 1). 5. The iron rod forming a hinge (area with oblique lines). The iron rod protrudes into the frame proper as described in the text. The furrow 'G' in FIG. 1 is indicated in this drawing by the middle straight line on the inside of the left frame (see also FIG. 4).
Figure 4:
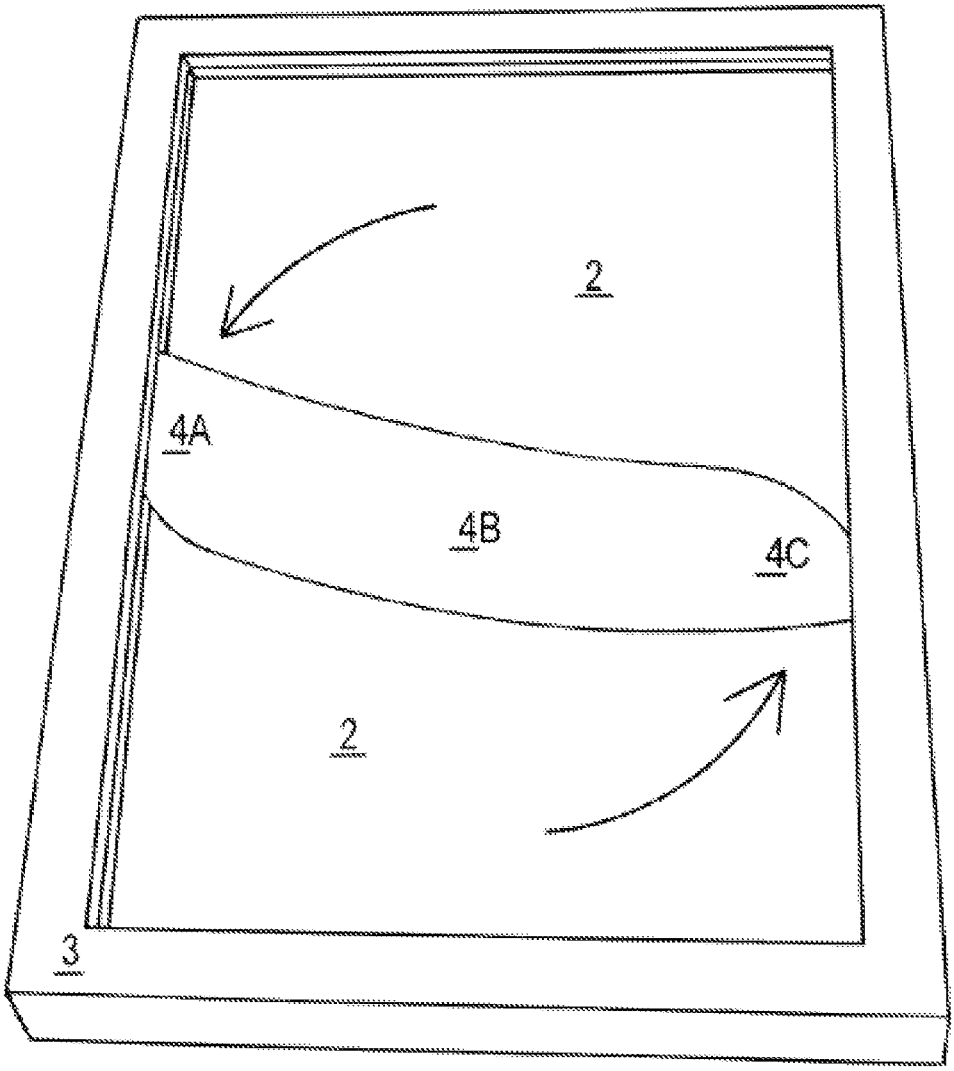
FIG. 4. Schematic perspective illustration of the artwork frame (as in FIG. 3) in a closed position wherein the piece of flat artwork has been positioned between the backpiece and the transparent surface referred to in FIG. 3 (now hidden from sight) showing the piece forming an arc with its ends 4A and 4B having been inserted into the furrow G of FIG. 1. This furrow, receiving the piece forming an arc, is indicated by a line on the left side of the frame but is hidden from sight on the right side of the frame due to the perspective angle. The label 4C indicates where the arc exerts pressure on the (center of the) back of the backpiece, this pressure is transmitted through the backpiece onto the artwork to the effect that the artwork is kept in position between the transparent surface of FIG. 3 and the front side of the backpiece, which is porous. The circular arrows indicate how the piece forming an arc has been rotated into position as described in the specification. 2. Backpiece. 3. Frame (as in FIG. 1). The metal rod is not shown here but its location is the same as in FIG. 3.

Example 1: One method is to start with a piece of wood with a cross-section of plainly 2.5 cm×2.5 cm not having any detailed profile features, saw at right angles, then drill holes for the hinges in the longer pieces of wood, then glue Part 1 onto the two short pieces of wood and one of the longer pieces of wood and after the glue has dried insert the hinge-rod of Part 2 into the holes of the longer pieces and glue the still loose long piece of wood to the rest of the frame so that Part 2 remains permanently attached between the two long pieces of the frame. Two-component Epoxy glue is suitable for this. Glue especially intended for wood is also available commercially. Subsequently, one can glue one strip of wood with angular-shaped cross section (shaped like a very wide (90 degrees) letter 'V') such that it envelopes the glass—Plexiglass—polycarbonate—Part 1 and the part of the frame facing outwards. Such strips of wood are readily available commercially. The various furrows facing inwards (FIG. 1) can then be made by gluing additional strips of wood and/or by drilling or using a chisel. The furrow marked with the letter 'G' in FIG. 1 must be continuous (spanning some length of the strip of wood) in order for the invention to function, it can not be just a drilled hole. The reason for this is that the sheet metal described in FIG. 2 is inserted by rotation tangentially along the furrow 'G'.

Example 2: Another way of manufacturing the invention manually which demonstrates the above claimed freedom to choose the exact measures of the invention is the following, adapted closely from the implementation described in the previous paragraph: In this example the transparent planar Part 1 is 32.5 cm×46.3 cm. On one side of this transparent surface, smoothly leveled along its two short edges are first glued two 30 cm long pieces of wood with a cross section of 6 mm×10 mm the latter measure facing the transparent surface, leaving voids symmetrically towards the surface's long edges. The kind of glue used depends on the material of which Part 1 has been made and every kind of material to be used in the invention manufactured in this manner should be compatible with some kind of glue. Furthermore most glues are compatible with wood. Now, with reference to FIG. 1 the transparent surface corresponds to the distance 'D' whereas the pieces of wood just laid form the distances 'E' and 'F'. Subsequently, 30 cm long pieces of wood with a rectangular cross-section of 2.1 cm×1.5 cm, are sawn at right angles and glued symmetrically onto the previously laid pieces of wood such that one each of their 1.5 cm surfaces becomes smoothly leveled with the previously mounted wood and with a short edge of the planar transparent surface. Then two 46.3 cm long pieces of wood are sawn at right angles from the wood having a cross section 2.1 cm×1.5 cm and fastened with screws onto the short ends of the 30 cm long pieces already mounted with their 2.1 cm measure facing the transparent surface and forming smooth joints with the already mounted wood. Before the second of these 46.3 cm long pieces is fastened, the backpiece, Part 2, with its rod-shaped hinge previously having been glued onto it, is laid in place towards the surface of Part 1. After the second long piece has been fastened one then has the shape of a rectangular frame to build further on. It has a void towards the transparent surface along the latter's long sides where the protrusions of the backpiece's rod are resting and this void forms part of the hole in which the rod-hinge is resting. Two short pieces of wood cut at right angles from the piece having the cross section 6 mm×10 mm may be inserted closely parallel to the hinge-rod and glued in position to form a fourth wall of the hole enclosing the protrusion of the rod into the space 'E'-'F' thus forming a hole in which the rod-hinge can rotate so that the back-piece (=Part 2) may flip open sufficiently to insert an artwork between it and Part 1.

The distance 'G' in FIG. 1 is implemented by gluing onto this structure another four pieces of the wood having a cross section of 6 mm×10 mm such that their 6 mm measures become smoothly leveled with the outside of the structure which is parallel to the line 'I' in FIG. 1. These pieces of wood are preferably cut with lengths to make the short ones overlap as much as possible onto the rest of the structure in order to contribute to the frame's stability. Subsequently, the distance 'H' in FIG. 1 is formed by gluing onto the rest of the structure towards the most recently laid 6 mm×10 mm pieces, another four long pieces of wood having a cross section of 21 mm×6 mm. These pieces are cut such that they overlap as much as possible with the adjacent pieces of the structure. They are laid with their flat surfaces facing the rest of the structure. One then has the core of a frame with the help of which the invention can be made to function. Onto this core is glued the frame proper, which is going to be visible from the outside along with the artwork, in a manner a) parallel to the contour 'A' and b) parallel to the contour 'I' in FIG. 1, covering the ugly joints that have appeared in this method of manually manufacturing the invention. In this example, pieces of oak wood 4.5 cm×0.8 cm were chosen for the front corresponding to the thickness 'C' in FIG. 1 and pinewood 3.5 cm×0.8 cm was chosen to cover the joints visible on the surface parallel to 'I'. The oak-wood was cut at an angle of 45 (135) degrees by reference to its length and joined with glue to Part 1 such that the four pieces formed a rectangle as in the case of most frames already on the market. This rectangle of oak wood should be made to cover the parts of the core of the frame that may otherwise be seen along with the artwork on display. The pinewood pieces were cut at right angles such that their joints when glued onto the frame were only visible from below and from above. They were joined with glue both to the oak-wood and to the surface parallel to 'I' in FIG. 1. The oak- and pinewood just laid corresponds to the V-shaped piece of wood in the preceding paragraph and exemplifies that the appearance of the frame as seen by the person watching the artwork can be varied just like in the case of frames already on the market. In this instance, for example, the pieces of oak wood forming the thickness 'C' protruded somewhat from the surface 'I' in FIG. 1.

The description above serves the purpose of demonstrating that the invention can be manufactured by various methods and with some freedom to choose the relevant measures. However, the claimed invention and the gist of the invention is independent of the method of manufacture. The detailed manufacturing just described is not suited for mass production but can be used by any more or less handy person having an elementary knowledge of wood joinery to guide the manufacture of one piece of the invented device.

Consider then the holes into which the rod serving as a hinge is inserted. These holes should be drilled into preferably the longer wooden strips (constituting the frame's length) so that they in the assembled device appear as close to the shorter strips (constituting the frame's width) as possible, under the protrusion marked with the letter 'B' in FIG. 1. There should not be any furrow marked 'F' where these holes are drilled. In the simplest conceivable configuration of the invention it is a circular hole that must be drilled into the longer strips, close enough to where a short side of Part 1 will be located when the main device has been assembled such that Part 2 can be rotated around this hinge and exert pressure onto Part 1 also considering the thickness of the porous paper on the surface of Part 2: The paper(s) and the artwork to be framed and displayed must not be so thick that Part 1 and Part 2 not can be made parallel by rotating around the hinge because if that happens the invention will not function. On the other hand, if there is too much play between Part 1 and Part 2 when Part 2 has been maximally rotated against Part 1 the invention will not function either since it will be impossible to exert pressure between the two surfaces to keep the piece of art in place. The configuration with circular holes must be made optimal regarding the position of the drilled hole in order to avoid these extremes. Such a configuration can easily be manufactured but there is a more elegant way to avoid these extremes: The holes into which the rod is inserted can be made oval and spiral springs can be inserted from another direction into the holes in such an orientation that they press the hinge towards Part 1. By reference to FIG. 1, the previously discussed circular holes and now the oval holes will be drilled from the left of the cross-section-drawing and the holes into which the spiral spring will be inserted should be drilled from the bottom of the cross section illustration (FIG. 1) and sufficiently deep that they reach the other holes. Then, after spiral springs sufficiently 'pushy' to perform their function of pressing the rod towards Part 1 have been inserted (this should be done after the main device has been assembled) the holes through which they have been inserted should be closed, for example with two very blunt screws (screws the ends of which have been cut at right angles) which have a diameter broad enough that they can be fastened into the holes and at the same time compress the springs. This more elegant configuration of the invention is not necessary for proving that the invention as claimed here works and the spiral-spring method may possibly have been claimed previously in other contexts or it is already in the public domain.

Some supplementary parts are shown in FIG. 2. All of them may not be needed for the invention to work and other designs that perform the same function can also be imagined. The purpose of these parts is to press Part 2 against Part 1 by inserting them into the main device as described below. Briefly, the item illustrated to the upper left in FIG. 2 is a wedge to be inserted into the furrow 'F' in FIG. 1 for the purpose of pressing the edges of Part 2 towards Part 1. Several such wedges can advantageously be used. The item illustrated in cross section to the upper right in FIG. 2 is intended to be placed in the furrow 'G' of FIG. 1 and then snapped into another furrow running along the edge of Part 2 thereby increasing the pressure of Part 2 onto Part 1. Both these items just described can be made of wood and covered with abrasive paper on their sides facing downward in the drawing. The latter is done in order to make the surface rough to increase the friction so that they remain in place. The item at the upper right in the drawing has been included in order to illustrate that many ways to tighten Part 2 against Part 1 may be conceived. Similar, however generally more complicated pieces of metal that perform the same function can be found in e.g. U.S. Pat. Nos. 5,042,180, 5,335,434, 7,069,682 B2, 7,536,814 B2, and 10,051,981 B2.

The item illustrated in the lower half of FIG. 2 represents a sheet metal to be mounted in an arc stretching from the bottom (in the drawing of FIG. 1) of the furrow 'G' on two opposing sides of the frame such that strain from the edge G-H is transmitted to Part 2 and causes the latter to exert pressure on Part 1 in its central part. All metals are not suited for this. Here, sheet brass (Example 1: 9×42.5 cm; Example 2: 9×33 cm), 1 mm thick, was used but there are better materials available, for example the kind of steel that is used in piano wire. Plainly cutting the sheet metal as described is sufficient for ascertaining that it grips into the wood. Any material that accomplishes this to the same extent will equally well accomplish that the claimed invention works. The just mentioned measures apply to the case that the distance perpendicular from the board, Part 2, when pressed against Part 1 to the dashed line at 'H' in FIG. 1 is 3.0 cm (Example 1, or 2 cm in Example 2) and the distance between the bottom of the furrows 'G' in FIG. 1 in two opposing sides of the frame is 41.5 cm (Example 1, or 32.2 cm in Example 2). These exact measures are only provided in order to enable anyone to verify that the invention can be built; the invention as such can be built by a skilled craftsman with a wide variety of herein unspecified measures. The sheet metal is cut so that it can be applied diagonally and then turned (rotated) until it exerts the desired pressure on Part 2. This shape with rounded corners as shown in the lower half of FIG. 2 is necessary for use in the invention. Without the rounded shape the invention would not work unless some other method to press the center of Part 2 against Part 1 could be found. It is an advantage if the partly rounded metal edge that will rest in the furrow G has some remaining sharpness as this will improve its grip on the wooden frame compared to a smoothed and ground edge. However, this poses the hazard of user accidents so a better way of achieving the same effect is to make very tiny saw-teeth indentations in said edge of the sheet metal. These saw-teeth should not point straight outwards from the metal but should point away from the long edge of the sheet metal. They should not be too sharp-pointed in order to preserve the possibility of easy removal of the metal from the frame (pressing down the mounted metal at its location near the wooden frame loosens its grip there). If very springy metals that are capable of storing much potential energy when bent are used, like for example the metal used in piano wire, then a sufficiently thick wire running with strain (much potential mechanical energy stored in its bending, that is) from two opposing parts of the frame at the position 'G'-'H' in FIG. 1 and snapped into place into a furrow on the back surface of Part 2 might accomplish the same effect as the sheet brass used here.

What I claim as my invention is:

1. A device for mounting and displaying flat pieces of art having the properties that one piece of art easily and reversibly can be positioned and mounted in and taken out of the device without being physically damaged, said device being composed of 1) A transparent front surface beneath which surface the piece of art is placed and can be viewed when mounted,
2) a rear board equipped with a porous front surface and
3) a rectangular or square-shaped frame attached to the front surface wherein the rear board can be opened like a door enabling mounting and removing the piece of art, said device being equipped with furrows in its frame into which supplementary parts can be reversibly inserted, and
4) one of these supplementary parts being a piece that is rotated into position from the rear of the device, while being rotated forming an arc between two opposing sides of the frame which arc increasingly exerts spring-like pressure onto the center of said rear board from the two opposing sides of the frame, and the said device in its entirety with said supplementary part forming an arc having been reversibly inserted beneath the board and included in the device to the effect that A) the artwork is kept in position towards the transparent surface by friction arising over the porous front surface of the rear board, said friction arising from the pressure being transmitted from the arc through the rear board onto its porous front surface whereby as a consequence of 'A', B) the rear board is held closed towards the front surface.

2. A device according to claim 1, characterized by that the piece forming an arc is a rectangular cut sheet metal with a length adapted for the indicated purpose and with corners rounded to allow its rotation in the furrows of the frame.

3. A device according to claim 2 characterized by that the sheet metal is brass having a thickness of 1 mm.

4. A device according to claim 1 characterized by that the porous surface on the front of the rear board is porous paper.

5. A device according to claim 1 wherein the rear board is equipped at one edge with a rod that serves as a hinge, which rod protrudes at both its ends into the frame.

6. A device according to claim 5 in which the rod is made of iron having a diameter of 5 mm and protruding 7 mm into the frame and the rod is attached with glue to the rear board.

7. A device according to claim 1 where the frame is made of wood.

8. A device according to claim 1 where the front surface is made of polycarbonate.

9. A device according to claim 1 where the rear board is made of a pressed wood material.

* * * * *